United States Patent [19]

Blake et al.

[11] 4,225,061

[45] Sep. 30, 1980

[54] FLUID DISPENSING DEVICE

[75] Inventors: William S. Blake, Miami Lakes; Walter H. Wesner, Plantation, both of Fla.

[73] Assignee: The AFA Corporation, Miami Lakes, Fla.

[21] Appl. No.: 862,257

[22] Filed: Dec. 19, 1977 (Under 37 CFR 1.47)

[51] Int. Cl.[2] ..... B65D 37/00

[52] U.S. Cl. ..... 222/207; 222/214; 222/383; 417/479; 417/472

[58] Field of Search ..... 222/207, 209, 211, 212, 222/213, 214, 215, 401, 382, 383, 384, 321; 239/333; 417/480, 472, 479

[56] References Cited

U.S. PATENT DOCUMENTS

| | | | |
|---|---|---|---|
| 3,726,442 | 4/1973 | Davidson | 222/207 |
| 3,986,694 | 10/1976 | Grogan | 222/207 |
| 3,995,774 | 12/1976 | Cooprider | 222/207 |
| 4,155,487 | 5/1979 | Blake | 222/207 |

*Primary Examiner*—Allen N. Knowles
*Attorney, Agent, or Firm*—Stanley A. Marcus

[57] ABSTRACT

A manually operated fluid dispensing device includes a first body component formed with a pump chamber and an upwardly opening cavity providing a valve housing that is closed by a second mating body component or cover having a projection that extends into the valve housing. A flat pliable valve element is clamped between said body components, said element being imperforate except for an opening through which said projection extends. A compressible bellows is associated with the pump chamber to form a variable volume pump chamber. The parts are all fabricated of thermoplastic materials and molding resins, the mating body components each being molded as a simple member of rigid plastic and including all passageways, grooves and ring seals required in the device.

21 Claims, 11 Drawing Figures

FLUID DISPENSING DEVICE

BACKGROUND OF THE INVENTION

1. Field of the Invention

This invention relates to improvements in manually operated fluid dispensing devices and is concerned, particularly, with features of construction that reduce the manufacturing cost, simplify the valving, and that facilitate assembly and inspection.

2. Description of the Prior Art

Many different forms of manually operated fluid dispensing devices have been proposed in the prior art for dispensing a wide variety of fluid products. One form disclosed in U.S. Pat. No. 3,061,202, granted Oct. 30, 1962 utilizes a spring return piston and cylinder pump with spring biased inlet and outlet check valves. Such an arrangement, in general, is complex, having many parts and is relatively costly to manufacture, assemble and inspect.

Other forms of dispensing devices, as disclosed in U.S. Pat. No. 3,986,644, granted Oct. 19, 1976, and U.S. Pat. No. 3,995,774, granted Dec. 7, 1976, employ a deformable bulb to define the pump chamber, the inlet and outlet valves comprising flap valves formed in a flange provided on the deformable bulb. A valve housing is closed by a cover plate that is firmly secured in sealing relation against the flange. Pressure in the valve housing, however, produces stresses in the plate that tend to cause leakage problems and valve interference, particularly in respect of the outlet valve that seals against the plate. Additionally, while such dispensing devices utilize but few parts, expensive and hard to obtain materials are required for the deformable bulb. As a result the manufacturing cost is high.

A copending application for patent of John R. Cary and Walter H. Wesner bearing Ser. No. 754,056, filed Dec. 23, 1976, now abandoned, said application being a continuation of their application Ser. No. 626,812, filed Oct. 29, 1975, now abandoned, discloses a form of fluid dispensing device in which the pump chamber is defined by a bellows pump having a closed end, an open end, and a sidewall having multiple flexible sections, and embodying in a single part, the functions of a piston, a fluid chamber, a return spring, and a valve. Since the bellows pump is molded from inexpensive and readily obtained plastic materials, a significant reduction in manufacturing cost is obtained. Other features of the device, and in particular, the valving arrangement leave something to be desired from the standpoint of assembly and inspection.

Thus, there still exists a need for further improvements in manually operated fluid dispensing devices, particularly in respect of a construction that simplifies the valving, the number of parts required, their manufacturing cost, and their handling, and additionally, the cost of assembly and inspection of the assembled devices.

SUMMARY OF THE INVENTION

Among the objects of the invention is the provision of an inexpensive, all plastic, fluid dispensing device that avoids the above mentioned problems of the prior art.

Another object of the invention is to provide an improved fluid dispensing device construction featuring significant reduction in the cost of assembly and inspection.

A further object of the invention is to provide a fluid dispensing device including a simplified valving arrangement.

A still further object of the invention is to provide, in a fluid dispensing pump, an improved valving arrangement incorporating a flat pliable element or membrane, said element being imperforate except for a single opening therein and requiring no apertures or flap cutouts to provide operative valve portions.

In accomplishing these and other objects, there is provided according to the present invention a manually operated fluid dispensing device comprising a first body component molded as a single member of rigid plastic and formed with an upwardly opening cavity of generally race-track shape, and providing a valve housing that is closed by a cover preferably formed integrally with the fairing or shroud of the fluid dispensing device and molded as a single member of rigid plastic, said cover whether or not formed integrally with the shroud being designated herein, for convenience, a second or mating body component. The first body component also has formed therein a pump chamber from which a common passageway connects to separate inlet and outlet passageways in the valve housing by way of a recessed intersecting passageway or groove in the lower surface of the cavity, and associated valve seats. The cover or second body component is formed with centrally located depending wall means, specifically a slotted hollow projection, that extends from the lower wall thereof into the common passageway, and is formed also with a connecting groove in the lower wall that leads to the end of the cover adjacent the inlet passageway. A flat pliable valve element or membrane is clamped in the valve housing between the first body component and the cover, the element being imperforate except for an opening through which the depending projection on the cover or second body component extends. Specifically, the valve element is clamped between cooperating raised sealing rings or bosses on the first and second body components, which sealing rings embrace the projection and extend to opposite sides of the components, thus separating the inlet side of the valve housing from the outlet side. The arrangement is such that fluid can flow between the inlet and outlet passageways only by way of the pump chamber. The valve element cooperates with the inlet and outlet valve seats in the first body component to control the flow of fluid through the inlet and outlet passageways, and as a result pressure in the valve housing tending to stress the second body component or cover does not interfere with or adversely affect the inlet and outlet valve opening and closing operations.

A compressible bellows pump having an open end, a closed end and multiple wall sections having inherent elastic memory is associated with the pump housing to provide a variable volume pump chamber.

BRIEF DESCRIPTION OF THE DRAWINGS

A better understanding of the present invention may be had from the following detailed description when read in connection with the accompanying drawings wherein.

DESCRIPTION OF THE PREFERRED EMBODIMENTS

Figure 1:
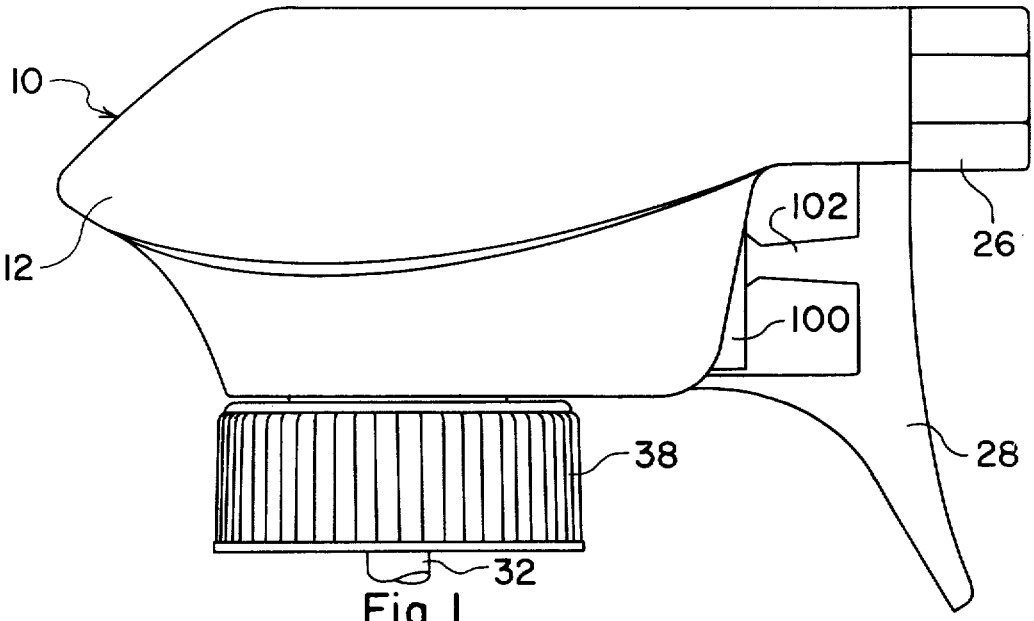
FIG. 1 is a side elevational view of a preferred embodiment of a manually operated fluid dispensing device, according to the present invention, providing horizontal actuation of a bellows pump.
Figure 2:
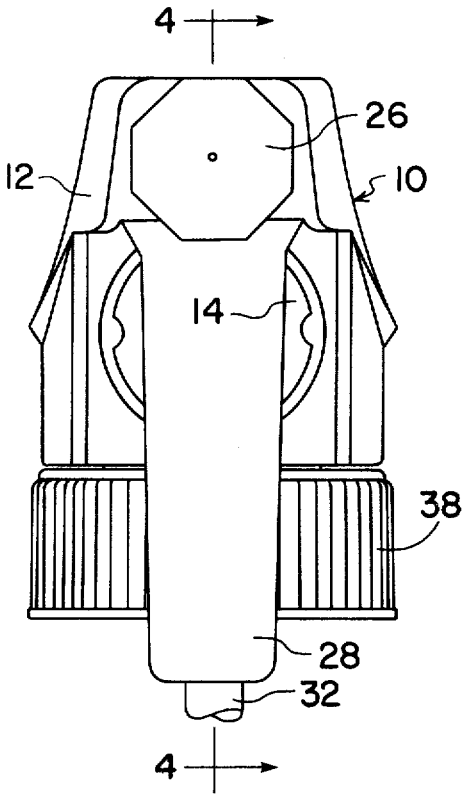
FIG. 2 is a front elevational view of the device.
Figure 3:
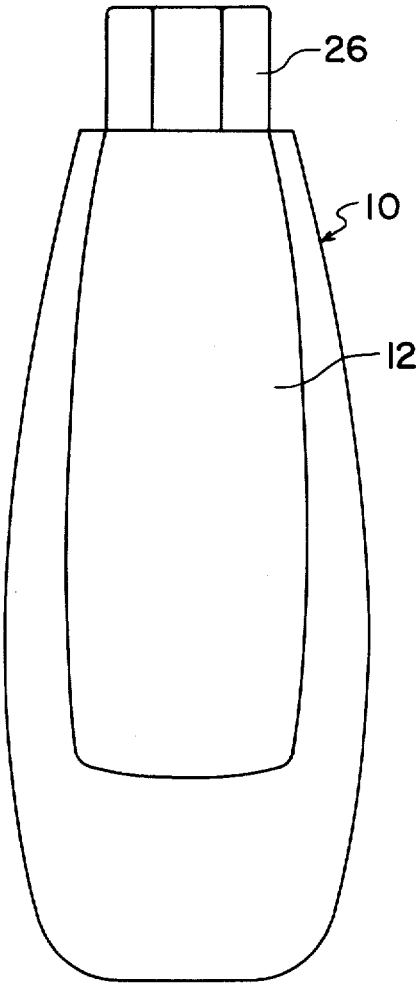
FIG. 3 is a top plan view of the device.

FIGS. 1 through 10 of the drawings illustrate an embodiment of the present invention comprising a horizontally actuated trigger sprayer or dispensing device 10. The device 10 includes a fairing or shroud 12, a hollow compressible bellows pump 14, a component body 16 having an upwardly opening generally race-track shaped opening or cavity forming a valve housing 18 and a bellows supporting hollow projection 20, and a mating component body cover 22 for the valve housing 18, said cover 22 being preferably molded integrally with shroud 12 as a single member of rigid plastic. The device 10 further includes a flat pliable valve element 24 clamped between body 16 and cover 22, a nozzle 26, a trigger lever 28, an adapter element 30, a dip tube 32, an inlet conduit 34 leading to an opening 36 in valve housing 18, and a bottle cap or fastening element 38 that threads onto the upper end of a container (not shown) of fluid product to be dispensed or sprayed.

The nozzle 26 may be suitably secured to the nose of the body 16 by press fitting on a suitable bushing, as shown, and retained in the end of an outlet bore 40 by press fitting therein.

Figure 4:
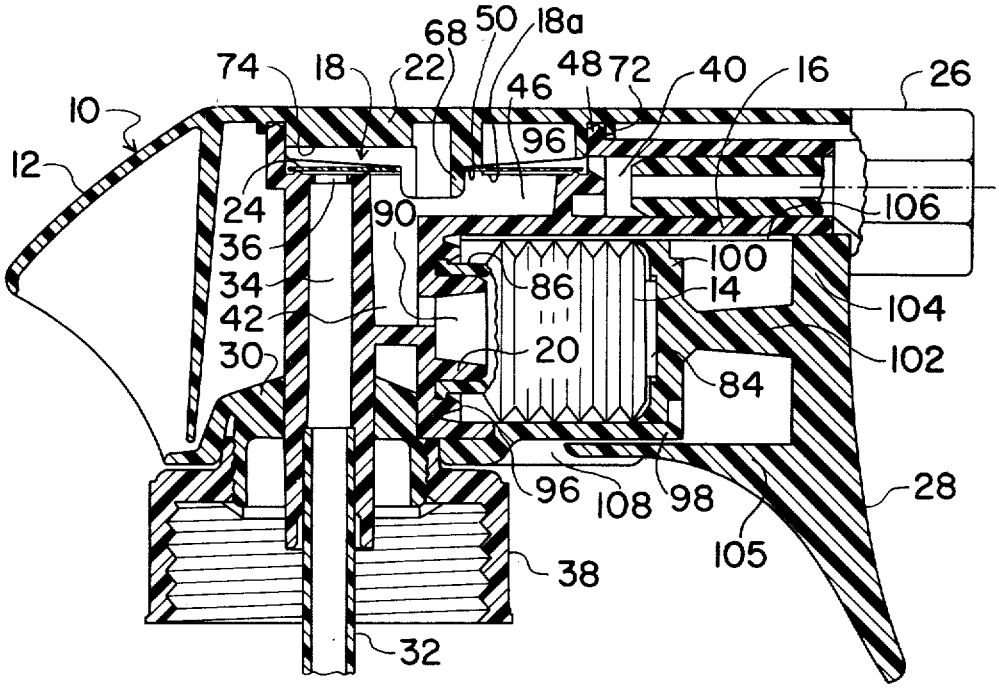
FIG. 4 is a vertical transverse view of the device taken on the line 4—4 of FIG. 2.
Figure 5:
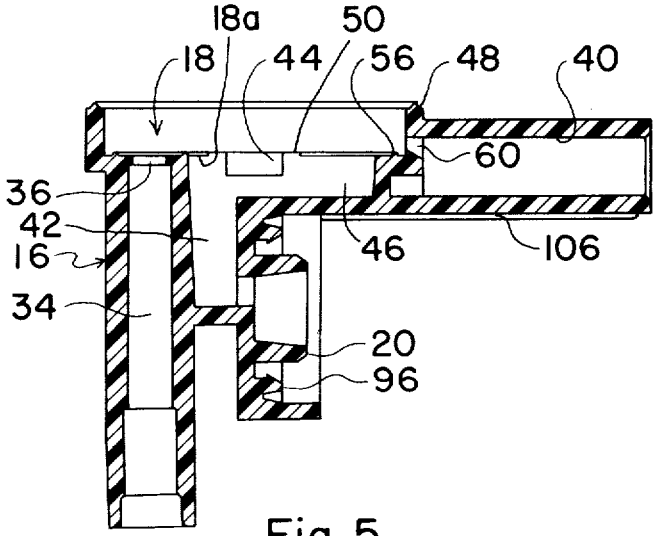
FIG. 5 is a cross section of a component body portion of the device that contains the pump chamber, a valve housing, and inlet and outlet passages, taken in the same plane as FIG. 4.
Figure 6:
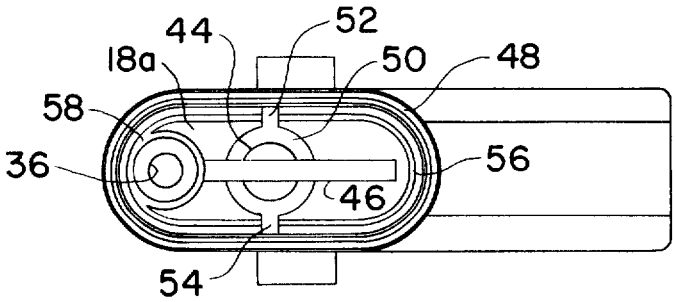
FIG. 6 is a top plan view of the component body portion of the device.

The first body 16 includes an L-shaped centrally located passageway 42 that connects the interior of the bellows supporting projection 20 with an opening 44 in the bottom, indicated at 18*a*, of the valve housing 18, as may be seen particularly by reference to FIGS. 4, 5 and 6. Passageway 42 and opening 44 are common to the inlet and outlet passageways in the device 10, as will be described further hereinafter. The opening 44, as shown in FIG. 6, connects with a passageway or groove 46 in the bottom 18*a* of the valve housing 18. The groove 46 extends centrally of the valve housing 18 for a substantial portion of the length thereof, from a position near inlet opening 36 to a position near the elliptically shaped sidewall 48 of the valve housing 18. The groove 46, as shown, intersects the centrally located opening 44 and a raised sealing ring or boss element 50 formed on the bottom surface 18*a* of the valve housing 18. Raised sealing ring or boss elements 52 and 54 radiate from the sealing ring 50, extending in opposite directions to the sidewall 48 of the valve housing 18, intersecting near the sidewall 48 with a slightly lower race-track shaped ring or boss element 56 that encircles the interior of the housing 18 adjacent wall 48. A further sealing ring or boss element 58 is formed on the bottom surface of housing 18 around the inlet opening 36. Boss 58 forms a valve seat for inlet opening 36. A hole formed in the sidewall 48 near the bottom thereof, and aligned with the groove 46 and the inlet opening 36, provides an outlet opening 60 from the valve housing 18, to the outlet bore 40 of the device 10. That half of the boss element 56 adjacent outlet opening 60 forms a valve seat for the opening.

Figure 7:
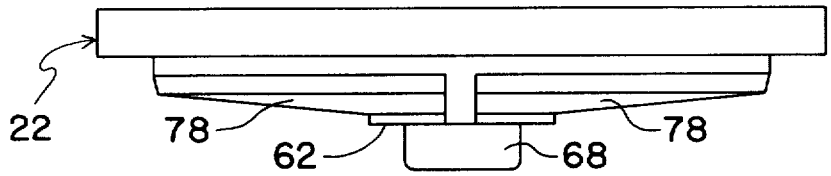
FIGS. 7 and 8 are side elevational and bottom plan views, respectively, of a second or mating body component providing a cover for the valve housing of the component body portion of the device, said cover in FIGS. 7 and 8, for convenience of illustration, being shown as a part separate from the shroud with which it is integrally formed as shown in FIG. 4.
Figure 8:
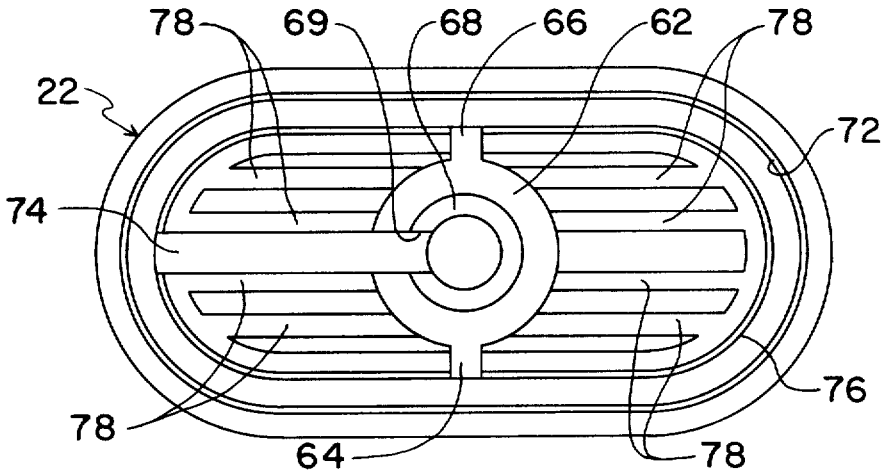
Figure 9:
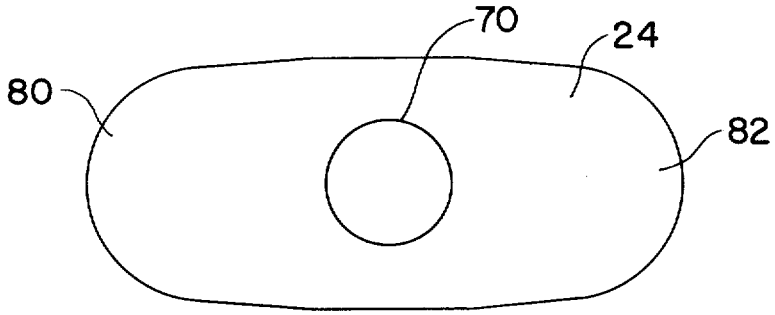
FIG. 9 is a top view of a flat pliable or easily bendable valve element employed in the valve housing of the component body portion of the device.

The flat pliable valve element 24, as shown in FIG. 9, is a thin plastic membrane having smooth upper and lower surfaces and desirably, may be formed as by machine stamping from a sheet or roll of suitable plastic film. Valve element 24 is clamped in sealing relation between the ring boss 50 and radiating boss elements 52 and 54 on the lower surface of valve housing 18 and a sealing ring or boss 62 and radiating sealing ring or boss elements 64 and 66 formed on the lower surface of the second component or cover 22, around a hollow projection 68 formed on and extending downwardly from the cover 22, as shown in FIGS. 7 and 8. Projection 68 has a slot 69 formed in the sidewall thereof extending for substantially the full length of the projection. Projection 68 extends through an opening 70 in valve element 24 into the centrally located opening 44 in the bottom surface 18*a* of valve housing 18 when valve element 24 is clamped in place. As seen in FIG. 4 the depth of the opening 44 in the bottom surface 18*a* of valve housing 18 is less than the depth of groove 46.

The second body component cover 22 has the same generally race-track shape as the valve housing or cavity 18 and further is provided with a peripheral downwardly depending flange 72 that embraces and encircles the outer wall 48 of the valve housing 18 when cover 22 is secured in place on component body 16. Desirably cover 22 is secured to body 16 by ultrasonic welding or other suitable bonding means.

A passageway or groove 74 on the lower surface of the second body component or cover 22 connects with slot 69 in the wall of projection 68 and extends centrally of the cover lower surface to an elliptically or race-track shaped ring or boss element 76 that is spaced from the flange 72, the groove 74 intersecting boss 76, also. As may be seen particularly in FIG. 4, the groove 74 extends in the direction of and terminates above the inlet opening 36 in the valve housing 18.

Several outwardly and upwardly tapering ribs, all designated by the numeral 78, as seen in FIGS. 7 and 8, are provided on the lower surface of cover 22 to provide space for the opposite end portions 80 and 82 of the flat valve element 24 to lift up or unseat, respectively, from the boss 58 around the inlet opening 36 and the boss 56 adjacent the outlet opening 60 in the wall 48 at the other end of the valve housing 18. Additionally, the ribs 78 limit the extent to which the end portions 80 and 82 of the valve element 24 may be lifted off their associate valve seats, and provide support for valve element 24 end portions 80 and 82 in their lifted positions. The ribs 78 also allow fluid to pack between them thereby to eliminate trapped air bubbles that could impair the efficient function of the device.

Figure 10:
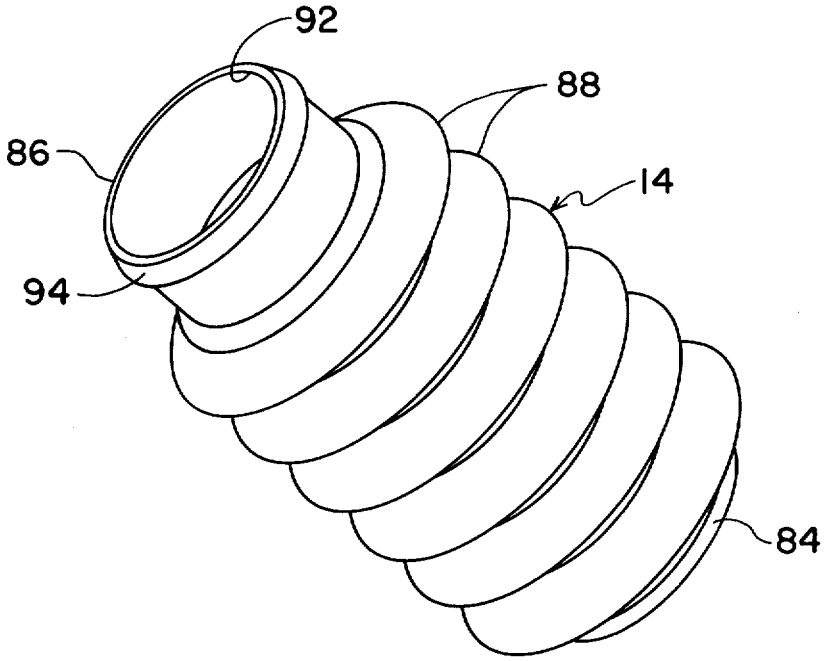
FIG. 10 is a perspective view of a hollow, compressible bellows associated with the pump chamber.

Compressible bellows 14, as seen in FIGS. 4 and 10, is sealed or closed at one end 84, and is open at the other end 86. Bellows 14 is of a unitary, blow molded, construction, a preferred form being the elastomeric compressible bellows shown, and has multiple flexible wall sections or corrugations 88 enclosing a pump chamber 90.

The open end 86 of bellows 14 is provided with a narrowed neck 92 that receives the projection 20 on component body 16 in sealing relation. Neck 92 has an inwardly tapered integral narrow flange or lip 94 on the open end thereof that cooperates with inwardly formed tabs 96 on component body 16 for retaining bellows 14 on the projection 20. Desirably, four such tabs 96 spaced 90° apart are provided.

Compressible bellows 14 is further supported on component body 16 by a split retaining sleeve 98 that desirably, although not necessarily, is formed integrally with the adapter element 30. A platform or disc 100 is provided in sleeve 98, in edge sliding engagement with the inner wall of the sleeve, and desirably ultrasonically welded to the closed end wall 84 of bellows 14. An extension 102 of trigger lever 28 is connected to platform 100. An upper trigger extension 104 and a lower trigger extension 105 are provided to guide trigger 28 in a straight or linear path when depressed. Upper trigger extension is slidingly received in a slot 106 in the lower wall adjacent the end of bore 40 of component body 16. Similarly, lower trigger extension 105 is slidingly received in a slot 108 in the lower surface of sleeve 98. As shown, trigger 28, trigger extensions 102, 104 and 105, and platform 100 preferably are integrally formed as a single member of rigid plastic.

Figure 11:
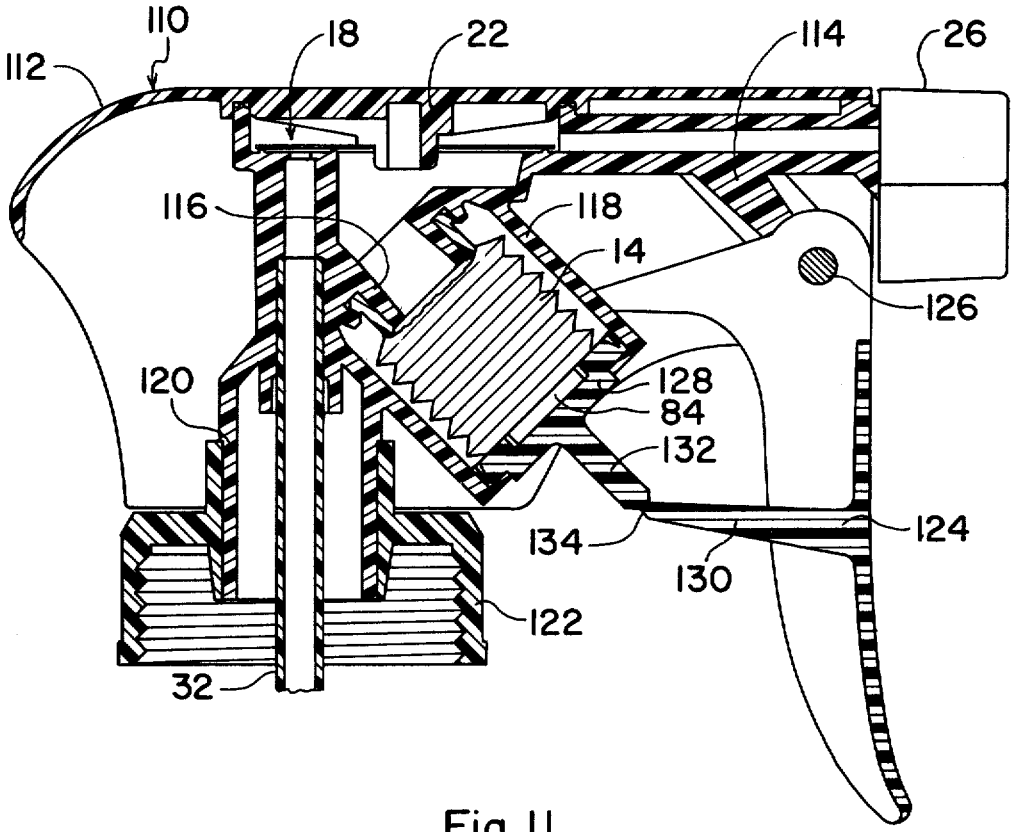
FIG. 11 is a vertical transverse sectional view of another embodiment of the manually operated fluid dispensing device, according to the present invention, providing for 45° actuation of the bellows pump.

Referring now to FIG. 11 there is shown another embodiment of the present invention wherein a dispensing device 110 incorporates a 45° actuation of the bellows pump instead of the horizontal actuation thereof provided in the fluid dispensing device 10 described in connection with FIGS. 1 through 10. The bellows pump 14, the valve housing 18 with its inlet and outlet passages and nozzle 26 of the fluid dispensing device 110 may be the same as the correspondingly identified parts of the dispensing device 10, and therefore, the same reference numerals have been used to identify corresponding parts in FIG. 11. As in device 10, the cover 22 of the valve housing 18 in FIG. 11 desirably is formed integrally with the shroud 112. As shown, a component body 114, a bellows pump supporting projection 116, a bellows pump supporting sleeve 118, and an adapter element 120 are integrally formed, preferably molded as a single member of rigid plastic. Adapter element 120 is press fit in an opening in the top of a bottle cap or fastening element 122 that threads on the upper end of a container (not shown) of fluid product to be dispensed.

In FIG. 11 the bellows supporting projection 116 and the sleeve 118 in which the bellows pump 14 is positioned are disposed on the component body 114 with the projection 116 facing downward at an angle of 45°. A trigger 124 is pivoted on a pin pivot 126, on the component body 114 and is connected to a platform 128 that supports the closed end 84 of bellows 14 by extensions 130 and 132, the latter of which are connected together by a living hinge 134. Platform 128 desirably is ultrasonically welded to the closed end 84 of bellows 14. Trigger 124, trigger extensions 130 and 132, living hinge 134, and platform 128 desirably are integrally formed as a single member, all of rigid plastic.

OPERATION OF THE PREFERRED EMBODIMENTS

In the operation of the invention embodiment of FIGS. 1 through 10, fluid dispensing device 10 is attached to a container (not shown) of fluid product to be dispensed by screwing cap 38 onto the upper portion or neck of the container. The dispensing device 10 is actuated by depressing or squeezing trigger 28 which forces trigger extension 102 and platform 100 against closed end 84 of bellows pump 14, applying a compressive stress thereon. As bellows pump 14 compresses, the length of the bellows 14 is substantially diminished, the volume of chamber 90 is substantially decreased and a pressure is generated in chamber 90 that is substantially higher than the ambient or atmospheric pressure.

Initially, only air is present in chamber 90 and the pressure increase thereof is transmitted by common passageway 42, opening 44 and the opening in hollow projection 68, slot 69 and the groove 74 in the lower surface of cover 22 to the space above the end portion 80 of the flat valve element 24. Such pressure increase forces the end portion 80 of the valve element 24 into sealing engagement with sealing ring or boss element 58 thereby closing the inlet opening 36. Simultaneously, the increase in pressure in pump chamber 90 is transmitted by common passageway 42, opening 44 and groove 46 to the lower side of the portion 82 of the valve element 24 adjacent the outlet opening 60 in the valve housing sidewall 48, thereby to cause the valve element portion 82 to lift off the boss element 56 adjacent the outlet opening 60 of the housing 18. Air in pump chamber 90 then passes through opening 60 into bore 40 and is ejected through nozzle 26.

Upon release of trigger lever 28, the inherent elastic memory of the elastomeric flexible wall sections, or corrugations 88 of bellows pump 14 causes the latter to expand to its original expanded configuration, returning the trigger lever 28, at the same time, to its original position, as shown in FIG. 4, the trigger extension members 104 and 105 guiding the movement of the trigger 28. This return expanding action of the bellows pump 14 develops a partial vacuum in the pump chamber 90, a pressure lower than atmospheric pressure that is transmitted by common passageway 42 and opening 44 and groove 46 to the space beneath the outlet portion 82 of valve element 24 adjacent outlet opening 60. This brings the valve element portion 82 down into sealing engagement with the sealing ring or boss element 56, thereby closing the outlet opening 60. Simultaneously, the reduced pressure in pump chamber 90 is transmitted by common passageway 42 and opening 44 and the opening and slot 69 in projection 68 to the space above the inlet portion 80 of the valve element 24, adjacent the inlet opening 36. This space, as previously noted, is sealed by the valve element 18 clamped between ring boss elements 50 and 62 and the radiating boss elements 52, 54 and 64, 66 from the space above the outlet opening 60. As a result, the portion 80 of the valve element above the inlet opening 36 is lifted off the boss 58 allowing fluid to be drawn into pump chamber 90 from the container holding the supply of fluid product to be dispensed, through the dip tube 32, inlet conduit 34, inlet opening 36, and passageway 42, filling pump chamber 90 with a charge of fluid to be dispensed.

On the next and subsequent depressing operations of trigger lever 28, the liquid in pump chamber 90 becomes pressurized by the compressively stressed bellows pump 14 which forces the portion 80 of valve element 24 adjacent inlet opening 36 into sealing engagement with sealing ring or boss element 58, closing the inlet opening 36. Simultaneously, the portion 82 of valve element 24 adjacent the outlet opening 60 is lifted off sealing ring or boss element 56, as above described, and allows fluid to flow through opening 60 into the discharge bore or conduit 40, to be dispensed from nozzle 26.

During the above described pumping and dispensing operation of the dispensing device 10, the fluid level in the container is lowered as fluid is dispensed or sprayed. This causes a partial vacuum to develop in the container unless venting thereof is provided. Those skilled in the art will understand that various arrangements to provide such venting are known in the prior art and may be adopted for use with the dispensing device of the present invention, as desired. For example, venting means comprising a gasket associated with the bottle closure cap 38 may be provided, as illustrated in the aforesaid copending application for patent of John R. Cary and Walter H. Wesner.

OPERATION OF THE EMBODIMENT OF FIG. 11

The operation of the fluid dispensing device 110 of FIG. 10 is essentially the same as the operation of the fluid dispensing device 10. The difference in the two dispensing devices resides principally in the horizontal disposition and actuation of the bellows pump 14 in the device 10 and the 45° disposition and actuation of the bellows pump 14 in device 110. The operation of the trigger lever 124 in effecting the desired compressing actuations of the bellows pump and the dispensing of fluid through nozzle 26 is believed to be evident from the drawing illustration.

Thus, there has been provided according to the present invention an improvement in the art of fluid dispensing devices comprising a first body component 16 formed with a pump chamber 90 and an upwardly opening cavity or valve housing 18. The pump chamber 90 is closed by bellows pump 14 and the valve housing 18 is closed by a mating body component or cover 22 having a hollow projection 68 depending therefrom and extending into the valve housing, with a flat valve element 24 clamped between said body components. All of these component parts are preferably fabricated of thermoplastic elastomeric materials and molding resins.

In the embodiment of FIGS. 1 through 10, the body component 16 and the mating body component including shroud 12 and cover 22 each preferably are molded as a single member of rigid plastic with the various passageways, grooves and ring bosses formed during the molding process. In the embodiment of FIG. 11, the body component 114, bellows pump supporting projection 116, sleeve 118 and adapter 120 are similarly formed as a single member of rigid plastic, as are also the shroud 112 and the cover 22.

The material for the valve element 24 may be selected from suitable commercially available plastic film sheet or roll, being manufactured by stamping therefrom. The bellows pump 14 comprises multiple flexible wall sections or corrugations and can be repeatedly flexed and unflexed to provide the desired bellows pump compressing and expanding actuations with little or no loss of elastic memory. The bellows pump 14, in the dispensing device of the present invention, combines, in a single part the operations of a piston, a fluid chamber, and a return spring. The bellows pump 14 can be constructed and fabricated in the configurations described, of thermoplastic elastomeric materials by any known process, a particularly preferred one being the well-known blow molding process. It has been discovered that by so doing, such a pump container can duplicate the tensile strength of a spring, allowing the same to be substantially reduced in length when compressively stressed from the closed bottom end and thereafter, due to its inherent elastic memory, recovering its original shape when the stress is removed. Any of the well-known plastics can be used, a preferred one being polyolefin, in particular, polyethylene, as described in the aforementioned application for patent of John R. Cary and Walter H. Wesner.

A significant advantage of the fluid dispensing devices described is their all plastic construction with the shroud and all necessary passageways, grooves and ring seals required for the necessary valving being formed in the mating body components during the molding process thereby simplifying the manufacture, inspection and assemblage of the device. A particular feature of the construction is the simplified valving arrangement allowing the use of a valve element 24 having little or no resilience whereby the element may be formed as by machine stamping from a sheet or roll of suitable plastic film, a manufacturing procedure that is much less costly than having to manufacture the element by a molding process. The valve element 24 is further characterized in its ease of storage, handling, and assembly, resulting from its being imperforate except for the relatively small centrally located opening 70 therein.

What is claimed is:

1. A valve housing for a fluid dispensing device including, a body component having wall means defining the sidewall and lower surface of a cavity, said sidewall including means forming an outlet passageway connecting said cavity and an outlet nozzle, and said lower surface including means forming an inlet passageway connecting said cavity to a source of fluid product to be dispensed, a pump chamber passageway connecting said cavity to a pump chamber, and a passageway intersecting said pump chamber passageway and extending substantially from said inlet passageway to said sidewall adjacent said outlet passageway, a cover for said cavity, said cover having interior surface means cooperating with said cavity lower surface to separate said inlet passageway from said outlet passageway and including depending wall means extending into said pump chamber passageway and defining a passageway therethrough connecting said pump chamber passageway to said inlet passageway, and a pliable valve element clamped between said cover and said cavity lower surface, said valve element being imperforate except for an opening through which said depending wall means extend and having an inlet portion and an outlet portion each of which portions seals against an individually associated portion of said cavity lower surface to close said inlet passageway and said outlet passageway, respectively.

2. A valve housing as specified in claim 1 wherein said cover interior surface means and said cavity bottom surface are each provided with sealing means, between which sealing means said valve element is clamped and which sealing means embrace said depending wall means.

3. A valve housing as specified in claim 2 wherein the breadth of said depending wall means is substantially less than the transverse dimensions of said cavity, said sealing means each comprising a sealing ring embracing said depending wall means and sealing elements radiating in opposite directions from said sealing ring.

4. A valve housing as specified in claim 3 wherein said depending wall means are imperforate except for said passageway therethrough whereby the space between said valve element and the interior surface of said cover that includes the inlet passageway is sealed from the corresponding space that includes the outlet passageway.

5. A valve housing as specified in claim 4 wherein said depending wall means comprise a cylindrical projection having a slot therein extending through said valve element and open toward said inlet passageway.

6. A valve housing as specified in claim 5 wherein said cover interior surface means includes a groove connecting said slot and said inlet passageway.

7. A valve housing as specified in claim 6 wherein said cover interior surface means includes ribs extending from said sealing ring toward both said valve element inlet and outlet portions and tapering away therefrom to provide a space individual to each of said valve element inlet and outlet portions into which said valve element inlet and outlet portions may deflect to open said inlet and outlet passageways, respectively.

8. A valve housing as specified in claim 7 wherein said cavity lower surface is planar and includes a seal adjacent the inner periphery thereof against which seal said valve element outlet portion seals to close said outlet passageway.

9. A valve housing as specified in claim 8 wherein said cavity lower surface includes a ring seal seat associated with said inlet passageway against which said valve element inlet portion seals to close said inlet passageway.

10. A fluid dispensing device including, a body component having wall means defining the sidewall and lower surface of a cavity, said sidewall including means forming an outlet passageway connecting said cavity and an outlet nozzle, and said lower surface including means forming an inlet passageway connecting said cavity to a source of fluid product to be dispensed, a pump chamber passageway connecting said cavity to a pump chamber, and a passageway intersecting said pump chamber passageway and extending substantially from said inlet passageway to said sidewall adjacent said outlet passageway, a cover for said cavity, said cover having an interior surface cooperating with said cavity lower surface to separate said inlet passageway from said outlet passageway and including depending wall means extending into said pump chamber passageway, said depending wall means defining a passageway therethrough connecting said pump chamber passageway to said inlet passageway, and a pliable valve element clamped between said cover and cavity cooperating surfaces, said valve element being imperforate except for an opening through which said depending wall means extend, said valve element having an inlet portion sealing against said cavity lower surface to close said inlet passageway and an outlet portion sealing against said cavity lower surface to close said outlet passageway, said inlet portion permitting flow into said pump chamber passageway through said inlet passageway but preventing flow out of said pump chamber passageway, and said outlet portion permitting flow out of said pump chamber passageway and preventing flow into said pump chamber passageway.

11. A fluid dispensing device as specified in claim 10 wherein said depending wall means are imperforate except for said passageway therethrough.

12. A fluid dispensing device as specified in claim 11 wherein the breadth of said depending wall means is substantially less than the transverse dimensions of said cavity.

13. A fluid dispensing device as specified in claim 12 wherein said cover and said cavity each include a ring seal between which ring seals said valve element is clampedand each of which ring seals embrace said depending wall means.

14. A fluid dispensing device as specified in claim 13 wherein said depending wall means comprise a cylindrical member having a slot therein extending through said valve element and facing toward said inlet passageway.

15. A fluid dispensing device as specified in claim 14 wherein said cover includes a groove connecting said slot and said inlet passageway.

16. A fluid dispensing device as specified in claim 15 wherein said cover further includes ribs extending from said ring seal thereon toward both of said valve element inlet and outlet portions and tapering away therefrom to provide a space individual to each of said valve element inlet and outlet portions into which said valve element inlet and outlet portions may deflect to open said inlet and outlet passageways, respectively.

17. A fluid dispensing device as specified in claim 16 wherein a seal is provided on said cavity lower surface adjacent the inner periphery thereof, against which seal said outlet portion of said valve element seals to close said outlet passageway.

18. A fluid dispensing device as specified in claim 17 wherein said lower surface of said cavity further includes a ring seal seat associated with said inlet passageway, against which ring seal seat said inlet portion of said valve element seals to close said inlet passageway.

19. A fluid dispensing device as specified in claim 18 including a variable volume pump chamber, said pump chamber being defined by a compressible bellows having corrugated sidewalls, a sealed end, and an open end mounted on said body component and having a connection to said pump chamber passageway, the sidewalls of said bellows having inherent elastic memory whereby said bellows is able to withstand repetitive compressive actuation that significantly varies its length and enclosed volume between expanded and compressed states.

20. A fluid dispensing device as specified in claim 19 including a trigger slideably mounted on said body component for compressively actuating said bellows.

21. A valve housing as specified in each of claims 1 or 10 wherein said pump chamber passageway includes in the lower surface of said cavity an opening that transversely cuts across said second mentioned passageway for a portion only of the depth thereof, said depending wall means extending through said opening for a distance no greater than the depth of said opening.

* * * * *